US006632163B2

(12) United States Patent
Zumbiel

(10) Patent No.: US 6,632,163 B2
(45) Date of Patent: Oct. 14, 2003

(54) LASER-ETCHING OF PAPERBOARD CARTON BLANKS

(75) Inventor: Edward A. Zumbiel, Lakeside Park, KY (US)

(73) Assignee: The C.W. Zumbiel Co., Cincinnati, OH (US)

( * ) Notice: Subject to any disclaimer, the term of this patent is extended or adjusted under 35 U.S.C. 154(b) by 45 days.

(21) Appl. No.: 09/818,820

(22) Filed: Mar. 27, 2001

(65) Prior Publication Data

US 2002/0142904 A1 Oct. 3, 2002

(51) Int. Cl.[7] ..... B31B 1/62

(52) U.S. Cl. ..... 493/128; 493/128; 493/150; 493/151; 493/264; 493/327; 156/272.8

(58) Field of Search ..... 53/476, 477, 452; 493/151, 189, 267, 264, 327, 331, 128, 150; 219/121.85; 156/272.8

(56) References Cited

U.S. PATENT DOCUMENTS 3,964,374 A * 6/1976 Stolkin et al. ..... 493/151
4,308,708 A * 1/1982 Focke ..... 53/136.4
4,308,712 A * 1/1982 Hagedorn ..... 53/566
4,491,383 A * 1/1985 Pera et al. ..... 359/201
4,540,392 A * 9/1985 Junod et al. ..... 156/272.8
4,562,687 A * 1/1986 Green, Jr. ..... 493/142
4,699,684 A * 10/1987 Osborne ..... 118/620
5,213,560 A * 5/1993 Crowley ..... 156/277
5,216,543 A * 6/1993 Calhoun ..... 136/246
5,614,339 A * 3/1997 Tankovich ..... 219/121.6
5,729,959 A * 3/1998 Spatafora et al. ..... 53/373.7
5,740,941 A * 4/1998 Lemelson ..... 220/62.15
5,792,301 A * 8/1998 Calvert et al. ..... 156/272.8
5,822,953 A * 10/1998 Kagawa et al. ..... 414/758
5,958,268 A * 9/1999 Engelsberg et al. ..... 134/1
6,059,182 A * 5/2000 Wein ..... 229/217
6,074,097 A * 6/2000 Hayashi et al. ..... 383/208
6,317,147 B1 * 11/2001 Tanaka ..... 347/116
6,350,343 B1 * 2/2002 Sauer ..... 156/272.8

FOREIGN PATENT DOCUMENTS

EP 0 233 755 A2 * 8/1987 ..... B29C/59/16

* cited by examiner

*Primary Examiner*—Rinaldi I. Rada
*Assistant Examiner*—Gloria R. Weeks
(74) *Attorney, Agent, or Firm*—Wood, Herron & Evans, LLP

(57) ABSTRACT

A carton blank is etched with a laser to remove at least a portion of a coating material on a glue panel area of the carton blank. The laser-etching process allows the use of cold-resin or other standard glue in manufacturing a carton from the carton blank, instead of a more expensive specialized glue which would be otherwise required to provide an adequate bond for the carton. The laser-etching process is controlled as a function of the coating material required to be removed from the glue panel of the carton blank, the speed of the carton blank as it is processed through the system, and the dispersion characteristics of the laser beam.

13 Claims, 2 Drawing Sheets

LASER-ETCHING OF PAPERBOARD CARTON BLANKS

BACKGROUND OF THE INVENTION

This invention relates generally to paperboard cartons. More particularly, this invention relates to a system and method for making a paperboard carton.

The converting of paperboard into carton blanks, and then into folding cartons, can be accomplished with a variety of paperboard substrates depending upon the needs and/or cost constraints of the manufacturer as dictated by the end-user. For example, beverage cartons for soft drink and beer cans traditionally utilize a clay-coated paper kraft board. Other consumable or non-durable retail consumer goods, however, are packaged in a wide variety of substrates including, but not limited to, clay coated recycled paperboard, solid bleached sulfate paperboard, poly-coated solid bleached sulfate paperboard, foil-coated paperboard (recycled and virgin), film coated paperboard (such as metalized polyesters laminated to paperboard substrates), wax-coated paperboard, and various other kinds of paperboard that have been treated, e.g., with special additives such as grease inhibitors.

In addition to the coatings and laminations that are part of the raw paperboard roll stock when it arrives at a carton manufacturer's plant, the manufacturer often further alters one or more characteristics of the board during the carton blank manufacturing process. Typical alterations of the surface of the paperboard include the graphics, and/or product information on the carton blanks. Different inks and coatings, of course, produce different surface characteristics on the paperboard.

The manufacturing process for folding cartons also includes an operation known as "finishing" whereby a printed and/or coated carton blank is folded and glued on a machine referred to in the industry as a "folder-gluer." Depending upon the surface characteristics of the particular carton blank being folded and glued, a glue must be selected which provides the best combination of adhesive strength and low cost. Typically, carton manufacturers utilize inexpensive cold-resin glues, not unlike what might be found in a bottle of Elmer's® glue. With ordinary clay-coated paperboard, cold-resin glues usually penetrate the clay coating and ink to impregnate the fibrous mass of the carton blank. The result is a bond sufficient to "pull fiber", i.e., sufficient to tear the paperboard of one or both glued together panels of the carton blank, when the carton is stressed or opened at the manufacturer's seam.

Problems occur, however, when the glue panels of a carton blank are treated with special inks, or covered with special foils, coatings, etc., which inhibit and/or prevent a cold-resin glue from bonding to the paperboard panels sufficient to "pull fiber." In these cases, carton manufacturers typically utilize costlier means to achieve an adequate bond. For example, special poly-glues and/or hot melt glues are often used in such difficult applications. In some cases, often with foilized substrates, manufacturers actually will scuff the carton blank with an abrasive element (e.g., sandpaper) at the point of contact where the board meets the glue in order to achieve an adequate bond. In other cases, manufacturers will flame-treat the carton blanks on the folder-gluer to change the surface tension of the substrate and allow for a better glue bond.

Simply stated, it is often problematic to glue carton blanks inexpensively, if at all, with cold-resin glues when the paperboard from which the carton blank is made has been coated and/or treated with agents that prevent the glue from creating a commercially adequate bond between glued together glue panels or flaps of the carton blank. In other words, if the glue does not penetrate the carton blank's coating layer, the result is a surface bond which is usually inadequate to hold the carton together during subsequent downstream operations, such as filling the carton with product, distributing the carton to a retailer, and retailing the carton to the end user of the product.

SUMMARY OF THE INVENTION

Therefore, it has been an objective of this invention to provide a system and method for manufacturing a paperboard carton utilizing cold-resin glues or other economical standard adhesives in order to permit an effective bond between the carton blank's glue panels and/or flaps even when the underlying substrate of the carton blank has been coated and/or treated with agents that ordinarily would prevent that glue from coming into contact with the fibers of the paperboard carton blank.

A still further objective of this invention has been to provide such a method and system which can be efficiently and economically utilized in the commercial production of paperboard cartons without detrimentally impacting the appearance or utility of the resulting cartons or the production speed of the cartons.

These and other objectives have been attained by a method and system whereby the paperboard carton blank is etched with a laser beam to allow for adequate adhesion of the carton blank's glue panels and/or flaps by cold-resin and/or other standard glues. In a presently preferred embodiment according to this invention, a supply of paperboard carton blanks is serially fed on a conveyor or the like through a work station. Each of the carton blanks has at least one glue panel or flap on which glue will be applied to erect the carton. The carton blank's glue panel initially has a coating layer which prevents or inhibits standard glues from adhering to the fibers of the paperboard to provide an adequate, commercially acceptable bond. According to this invention, a laser beam is directed onto the glue panel on each of the carton blanks so as to remove at least a portion of the coating layer on each glue panel. This allows a cold-resin or other standard glue to be effectively applied to the laser-etched glue panel, and the carton blank subsequently to be successfully folded and glued into a carton configuration. Each carton blank's laser-etched glue panel enables the cold-resin glue to bond with the fibers of the paperboard so as to produce an adequate bond to hold the carton together during subsequent downstream operations such as filling the carton with product, and distribution of the carton to a retailer and, ultimately, to a retail purchaser.

Additionally, the presently preferred embodiment of the invention includes dispersing the laser beam through an optical lens or other mechanism in order to direct the laser beam over a desired area of the glue panel for removal of the unwanted coating layer in that area. Moreover, the intensity of the laser beam is controlled electronically as a function of the speed of the carton blanks through the work station, the dispersion of the laser beam, and the depth of the etching desired (i.e., the amount of the unwanted coating layer to be removed on the glue panels of the carton blanks being processed).

As a result of the laser-etching method and system according to this invention, carton blanks can be glued inexpensively with cold-resin or other standard glues even when the paperboard carton blank has been coated and/or treated with a coating layer or other agents that typically prevent such glues from coming into contact with the paperboard fibers of the carton blank. After the glue panel of the carton blank has been etched with the laser, the cold-resin glue is applied to that glue panel, and it tends to impregnate to some extent the paperboard so as to provide an effective adhesive bond after gluing the carton blank into carton configuration. Moreover, this invention can be integrated into a production process for manufacturing cartons from carton blanks by controlling the intensity of the laser beam as a function of the speed of the carton blanks transported through the process, the dispersion of the laser beam, and the desired etching depth on the glue panel of the carton blank, all without detrimentally impacting cost or efficiency of the process.

BRIEF DESCRIPTION OF THE DRAWINGS

The objectives and features of the invention will become more readily apparent from the following detailed description taken in conjunction with the accompanying drawings in which.

DETAILED DESCRIPTION OF THE DRAWINGS

Figure 1:
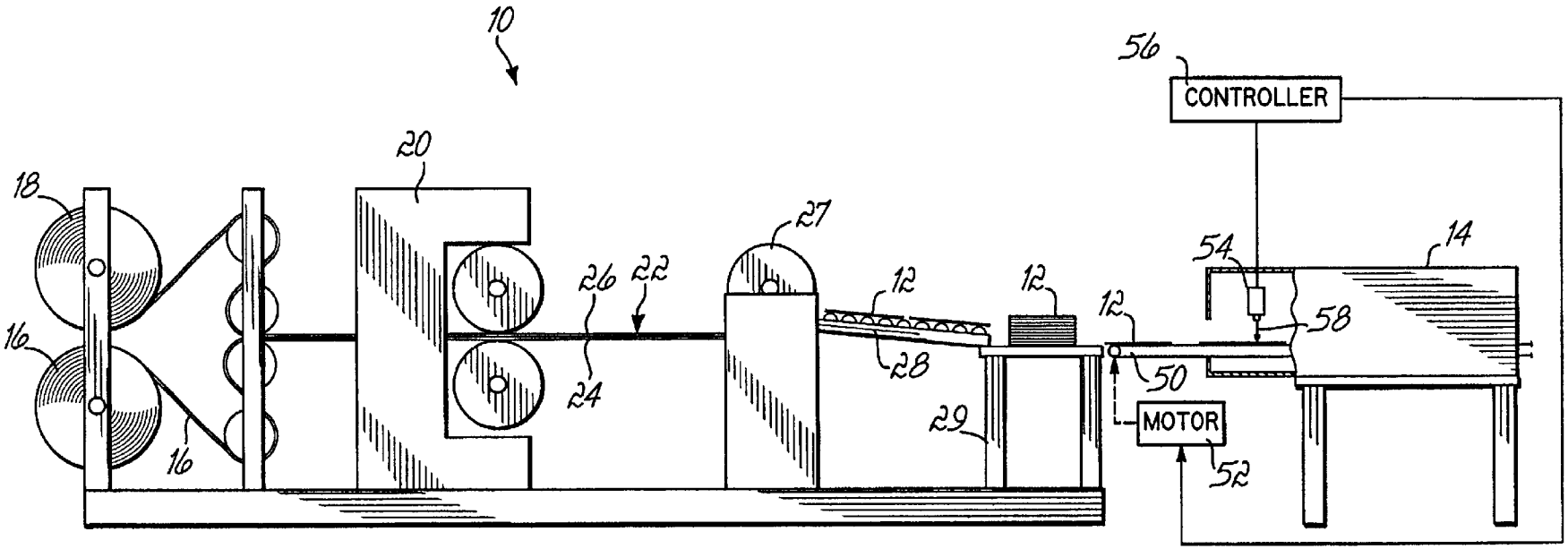
FIG. 1 is a schematic representation of a system and method for manufacturing carton blanks, including laser-etching a glue panel of each carton blank to remove an undesired coating layer, according to a presently preferred embodiment of this invention.

A presently preferred embodiment of a system 10 and method according to this invention is shown schematically in FIG. 1. The system 10 produces a supply of carton blanks 12 to be subsequently serially processed at a workstation through a standard folder-gluer apparatus 14. The carton blanks 12 are made of any material and may include a typical paperboard, e.g., kraft board, clay-coated kraft board or any one of numerous other known paperboards 16 utilized in the carton manufacturing industry. The paperboard 16 is supplied on a roll, and may be laminated or coated with a coating material, e.g., with a pre-printed film 18 (also supplied on a roll) in a laminating or application unit 20. The pre-printed film 18 may be provided with product information, advertising, graphics or the like. The application unit 20, therefore, produces a web 22 which carries multiple uncut carton blanks 12. In the example shown, web 22 has a paperboard side 24 and a film side 26 carrying a layer of the pre-printed film 18. The thickness of the paperboard 24 is typically on the order of 0.015 inches to 0.017 inches. Therefore, the web 22 is cut into multiple separate carton blanks 12 at a cutting unit 27. The individual carton blanks 12 are then transferred by a conveyor 28 to table 29 where they are held prior to subsequent processing in the folder-gluer apparatus 14.

Figure 1A:
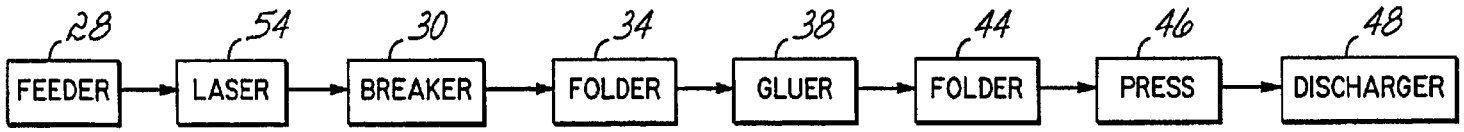
FIG. 1A is a block diagram representation of an exemplary folder-gluer system.

The folder-gluer apparatus 14 is shown schematically in FIG. 1A, and functions to fold and glue each carton blank into a knocked down or flattened carton that can be subsequently erected at, e.g., a soft drink canner plant, where it is filled with cans of soft drink for the retail marketplace. Such machines 14 are well known in the industry and, e.g., are commercially available from the Bobst Company (www.bobst.com). A folder-gluer machine 14 typically comprises a succession of modules, the number of which depend on the complexity of the manufacturing operations required by the type of carton in production. Typically, the modules generally include at least a feeder 28 feeding the carton blank 12 from a pile, on, e.g., the table 29, and a breaker module 30 which pre-breaks selected creases 32 (see FIG. 2) of the carton blank 12. Additionally, a folding module 34 may fold selected panels or flaps of the blank 12 prior to a gluing station 38. The gluing station applies glue 40 to one or more selected glue panels 42 of the carton blank 12. Various downstream guides (not shown) and folding modules 44 are then utilized to fold the carton blank 12 into a collapsed or flattened carton configuration. A pressing device 46 compresses the various creases and arranges the cartons in a stream and forwards them to a discharge module 48 which receives the folded cartons while keeping them pressed to allow the glue 40 to dry. The conveyor 50, in a typical installation, may be operationally driven by a motor 52 at a speed of between 1,000 to 2,500 feet per minute. This folder-gluer apparatus setup is, as noted, well known to the prior art.

The present invention advantageously utilizes a laser beam unit 54 to etch or remove at least a portion of the coating layer 26 from the carton blank 12 along one or more glue panels 42 of the carton blank 12. In a presently preferred embodiment, a low power sealed $CO_2$ laser (50 to 200 watts or greater) is operationally connected with the folder-gluer 14. Examples of laser beam units 54 which could be utilized in this invention are the Excalibur 600 and Evolution 240 models commercially available from Synrad, Inc. (www.synrad.com). The laser beam unit 54 is coupled to a controller 56 which is likewise coupled to the motor 52 that drives the conveyor 50. The controller 56 regulates the intensity of laser beam 58 (see FIG. 2) emanating from the laser beam unit 54 as a function of the speed of the motor driven conveyor 50, the dispersion of the laser beam 58, and the desired depth of the etching for the particular coating layer 26 being processed. One such controller is the UC-1000 Universal Controller available from Synrad, Inc.

Preferably, the laser beam 58 emanating from the laser beam unit 54 is dispersed through an optical dispersion lens 60 or the like to appropriately cover or target the desired portion of the glue panel 42 or carton blank 12 from which the coating layer 26 is to be removed. The laser beam 58, being appropriately tuned to the desired power setting, etches or removes the coating layer 26 on the paperboard 24 at the desired width and exposes either the clay coating or the actual fibers 62 of the paperboard substrate 24 in order to prevent application of the glue 40 to that coating layer 26. The intensity of the laser beam 58 is controlled by the controller 56 electronically in conjunction with the speed of the conveyor 50 (i.e., in conjunction with the speed of movement of the carton blanks 12 through the folder-gluer 14) to prevent both the unintentional destruction of the carton blank 12 in the case of a laser beam 58 which is too strong and likewise to prevent excess coating 26 remaining on the glue panel 42 in the case of a laser beam 58 which is too weak.

Figure 2:
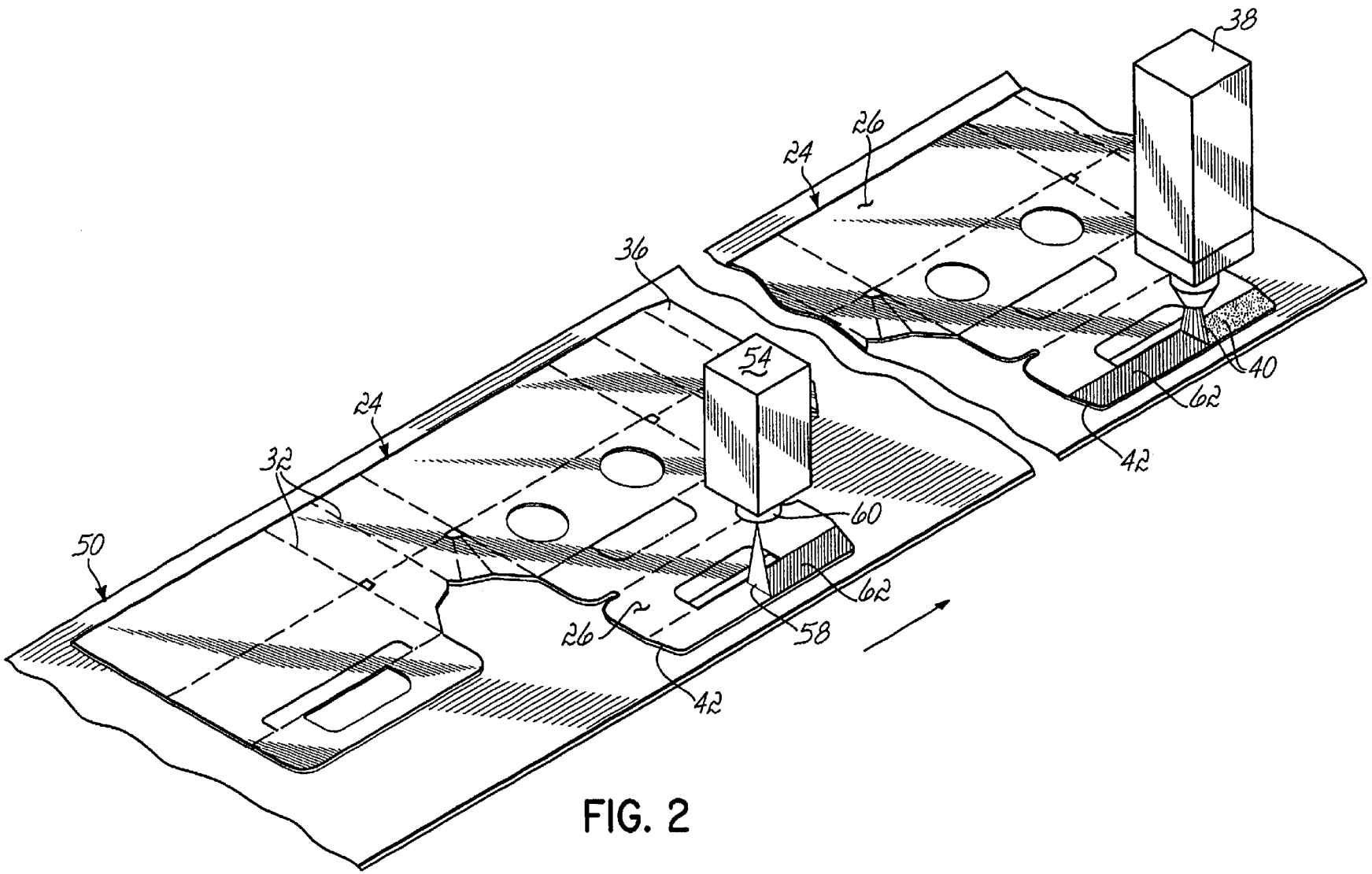
FIG. 2 is a schematic representation of a laser beam source etching the glue panel of the carton blank on a conveyor in the system of FIG. 1, and glue being applied to the laser-etched glue panel of the carton blank.

Referring to FIG. 2, as previously noted, the laser beam 58 etches the glue panel 42 and removes at least a portion of the coating layer 26 on the carton blank substrate 24. Subsequently, the conveyor 50 moves the laser-etched carton blank 12 to the gluing module 38 of the folder-gluer 14 where preferably a cold-resin glue 40 or other appropriate glue is applied to the laser-etched portion 62 of the glue panel 42. The glue 40 may be sprayed on, extruded from a gun, laid down by a wheel, or applied in any one of many other known methods. The carton blank 12 then continues being processed through the folder-gluer 14 where it is folded into a knocked down or flattened configuration (not shown). The flattened carton thereafter is shipped to an end user where it is erected into its final three-dimensional configuration and filled with product, e.g., can of soft drink.

As a result of this invention, expensive glues such as poly-glues and hot-melt glues are not required, and cold-resin or other economical glues 40 can be utilized, even when carton blanks 12 include a coating material 26 which typically would inhibit or prevent the cold-resin glue 40 from achieving an adequate bond with the carton blank 24. Furthermore, the laser-etching and selective removal of the coated material 26 is controlled and optimized by a controller 56 for a particular production process, same being dependent on the speed of the conveyor 50 transporting the carton blanks 12, the dispersion of the laser beam 58, and the desired etching depth for removal of the coated material 26.

From the above disclosure of the general principles of the present invention and the preceding detailed description of a preferred embodiment, those skilled in the art will readily comprehend the various modifications to which this invention is susceptible. Therefore, I desire to be limited only by the scope of the following claims and equivalents thereof.

I claim:

1. A method for manufacturing a carton comprising the steps of serially feeding a supply of paperboard carton blanks through a work station, each said blank having a paperboard substrate, a glue panel and a coating layer covering at least a portion of said glue panel, directing a laser beam onto each of said carton blanks to remove at least a portion of said coating layer and expose a portion of said paperboard substrate on each of said the glue panels, applying glue from a gluing module to that portion of each of said glue panels from which said coating layer has been removed by said laser beam, allowing said glue to impregnate and bond with said paperboard substrate, folding each carton blank into a configuration where said glue panel is glued to another panel of said carton blank, and folding said carton blanks into a flattened configuration whereby they can be shipped to a user for erection into a final three-dimensional product-holding configuration.

2. The method of claim 1 further comprising the step of:

linearly dispersing said laser beam so as to cover a predetermined area of said glue panel.

3. The method of claim 2, said dispersing being accomplished optically.

4. The method of claim 1 further comprising the step of:

adjusting the intensity of said laser beam so as to remove a predetermined amount of said coating layer on each said glue panel.

5. The method of claim 1 further comprising the step of regulating the intensity of said laser beam as a function of at least one of the speed of said serially fed carton blanks, the dispersion of said laser beam, and the amount of said coating layer on each of said glue panels to be removed.

6. The method of claim 1, wherein said glue applied to each of said panels being a liquid cold-resin glue.

7. The method of claim 1 wherein the applying glue step is accomplished by spraying glue from said gluing module.

8. The method of claim 1 wherein the applying glue step is accomplished by laying down glue by a wheel in said gluing module.

9. The method of claim 1 wherein the applying glue step is accomplished by spraying glue from said gluing module.

10. A method for manufacturing a carton comprising the steps of serially feeding a supply of paperboard carton blanks through a work station, each said blank having a paperboard substrate, a glue panel and a coating layer covering at least a portion of said glue panel, directing a laser beam onto each of said carton blanks to remove at least a portion of the coating layer and expose a portion of said paperboard substrate on each of said glue panels, optically linearly dispersing said laser beam to cover a predetermined area of each of said glue panels, regulating the intensity of said laser beam as a function of at least one of the speed of said serially fed carton blanks, the dispersion of said laser beam, and the amount of said coating layer on each of said glue panels to be removed, applying glue from a gluing module to that portion of each of said glue panels from which said coating layer has been removed by said laser beam, allowing said glue to impregnate and bond with said paperboard substrate, folding each carton blank into a configuration where said glue panel is glued to another panel of said carton blank, and folding said carton blanks into a flattened configuration whereby they can be shipped to a user for erection into a final three-dimensional product-holding configuration.

11. The method of claim 10 wherein the applying glue step is accomplished by extruding glue from a gun in said gluing module.

12. The method of claim 10 wherein the applying glue step is accomplished by laying down glue by a wheel in said gluing module.

13. The method of claim 10 wherein the applying glue step is accomplished by laying down glue by a wheel in said gluing module.

* * * * *

UNITED STATES PATENT AND TRADEMARK OFFICE

CERTIFICATE OF CORRECTION

PATENT NO. : 6,632,163 B2
DATED : October 14, 2003
INVENTOR(S) : Edward A. Zumbiel It is certified that error appears in the above-identified patent and that said Letters Patent is hereby corrected as shown below:

Column 6,
Line 55, "accomplished by laying down" should read -- accomplished by spraying --.

Signed and Sealed this

Twenty-third Day of December, 2003

JAMES E. ROGAN
*Director of the United States Patent and Trademark Office*